US011094204B2

(12) United States Patent
Trim et al.

(10) Patent No.: US 11,094,204 B2
(45) Date of Patent: Aug. 17, 2021

(54) UNMANNED AERIAL VEHICLE FLIGHT PATH EFFICIENCY THROUGH AERODYNAMIC DRAFTING

(71) Applicant: INTERNATIONAL BUSINESS MACHINES CORPORATION, Armonk, NY (US)

(72) Inventors: Craig M. Trim, Ventura, CA (US); Todd Russell Whitman, Bethany, CT (US); Jeremy R. Fox, Georgetown, TX (US); Jeremy Adam Greenberger, San Jose, CA (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 337 days.

(21) Appl. No.: 16/204,714

(22) Filed: Nov. 29, 2018

(65) Prior Publication Data

US 2020/0175881 A1 Jun. 4, 2020

(51) Int. Cl.

| | |
|---|---|
| ***G06G 7/70*** | (2006.01) |
| ***G06G 7/76*** | (2006.01) |
| ***G08G 5/00*** | (2006.01) |

(52) U.S. Cl.

CPC ..... *G08G 5/0021* (2013.01); *G08G 5/0039* (2013.01); *G08G 5/0069* (2013.01)

(58) Field of Classification Search

CPC ... G08G 5/0021; G08G 5/0039; G08G 5/0069
USPC ..... 701/122
See application file for complete search history.

(56) References Cited

U.S. PATENT DOCUMENTS

| | | | | |
|---|---|---|---|---|
| 5,521,817 | A | 5/1996 | Burdoin et al. | |
| 9,334,052 | B2 | 5/2016 | Pasko et al. | |
| 9,355,423 | B1 | 5/2016 | Slusar | |
| 9,471,064 | B1 | 10/2016 | Boland et al. | |
| 10,152,195 | B2 * | 12/2018 | Lacko | G06F 3/0481 |

(Continued)

FOREIGN PATENT DOCUMENTS

| | | | |
|---|---|---|---|
| WO | 2017044079 | A1 | 3/2017 |
| WO | 2018106235 | A1 | 6/2018 |

OTHER PUBLICATIONS

IP.com Search—Dec. 28, 2020-1.*

(Continued)

*Primary Examiner* — Mahmoud S Ismail
(74) *Attorney, Agent, or Firm* — Brian Restauro; Andrew D. Wright; Roberts Calderon Safran & Cole, P.C.

(57) ABSTRACT

A method includes: retrieving an initial flight path for a first unmanned aerial vehicle (UAV), the initial flight path being from a geographical point A to a geographical point B; generating a projected initial energy consumption of the first UAV for completion of a flight along the initial flight path; retrieving a flight path of a second UAV; generating a projected revised energy consumption of the first UAV for completion of a flight along an altered flight path, the altered flight path being a flight path from point A to point B where the first UAV aerodynamically drafts the second UAV for at least a portion of the altered flight path; comparing the projected revised energy consumption to the projected initial energy consumption to determine which of the projected revised energy consumption and the projected initial energy consumption is lower.

20 Claims, 11 Drawing Sheets

(56) References Cited

U.S. PATENT DOCUMENTS

| | | | | |
|---|---|---|---|---|
| 2007/0168090 | A1* | 7/2007 | DeMarco | G08G 5/0086 701/23 |
| 2016/0104168 | A1 | 4/2016 | Moore et al. | |
| 2016/0111006 | A1 | 4/2016 | Srivastava et al. | |
| 2016/0293016 | A1* | 10/2016 | Rein-Weston | G01C 21/3469 |
| 2019/0103032 | A1* | 4/2019 | Sasaki | G01C 21/20 |
| 2019/0324445 | A1* | 10/2019 | Yang | G08G 5/003 |
| 2020/0033892 | A1* | 1/2020 | Aldarwish | B64D 45/08 |

OTHER PUBLICATIONS

IP.com Search—Dec. 28, 2020-2.*

Anonymous, "Reducing battery usage in drones", An IP.com Prior Art Database Technical Disclosure, IPCOM000252064D, Dec. 14, 2017, 6 pages.

Anonymous, "Dynamically Identifying an Optimal Following Distance for Driverless Cars in a Slipstream Chain", An IP.com Prior Art Database Technical Disclosure, IPCOM000240953D, Mar. 13, 2015, 5 pages.

Zhai et al., "Cooperative Look-Ahead Control of Vehicle Platoon or Maximizing Fuel Efficiency under System Constraints", IEEE, 2018, 13 pages.

Unknown,"AI-Powered Drones Are Coming: What It Means for Business", blog.hbcommunications.com/ai-powered-drones-are-coming-what-it-means-for-business, Accessed Nov. 7, 2018, 2 pages.

McNabbon, "Boeing and MIT Build New Wind Tunnel for Drones and Other Aerospace Ideas", Drone Life, Dec. 7, 2017, 2 pages.

Kratochwill,"Stanford Builds a Wind Tunnel for Birds and Drones", Popular Science, Apr. 22, 2016, 5 pages.

Mell et al., "The NIST Definition of Cloud Computing", NIST, Special Publication 800-145, Sep. 2011, 7 pages.

Marcus, "Bike Skill: How to Draft". Bicycling.com, Mar. 31, 2014, Retrieved from <https://www.bicycling.com/training/bikeskills/bike-skill-how-draft>, 6 pages.

Aumann, "The art of the draft". Nascar.com, Oct. 2, 2012, Retrieved from <https://web.archive.org/web/20121005114444/http://www.nascar.com/news/121002/ups-game-changers-art-of-draft/index.html>, 4 pages.

"Drafting", Wikipedia.com, Feb. 4, 2018, Retrieved from <https://en.wikipedia.org/wiki/Drafting_(aerodynamics)>, 6 pages.

* cited by examiner

UNMANNED AERIAL VEHICLE FLIGHT PATH EFFICIENCY THROUGH AERODYNAMIC DRAFTING

BACKGROUND

The present invention relates generally to unmanned aerial vehicles and, more particularly, to improving the efficiency of unmanned aerial vehicles by altering flight paths to gain an aerodynamic advantage from drafting.

Unmanned Aerial Vehicles (UAVs) are becoming increasingly attractive to businesses for use in delivering packages and other items. Maximizing the efficiency of UAVs can be a benefit to businesses and other entities that operate fleets of UAVs.

SUMMARY

In a first aspect of the invention, there is a computer-implemented method including: retrieving, by a computer device, an initial flight path for a first unmanned aerial vehicle (UAV), the initial flight path being from a geographical point A to a geographical point B; generating, by the computer device, a projected initial energy consumption of the first UAV for completion of a flight along the initial flight path; retrieving, by the computer device, a flight path of a second UAV; generating, by the computer device, a projected revised energy consumption of the first UAV for completion of a flight along an altered flight path, the altered flight path being a flight path from point A to point B where the first UAV aerodynamically drafts the second UAV for at least a portion of the altered flight path; comparing, by the computer device, the projected revised energy consumption to the projected initial energy consumption to determine which of the projected revised energy consumption and the projected initial energy consumption is lower; establishing, by the computer device, the altered flight path as a chosen flight path if the projected revised energy consumption is lower than the projected initial energy consumption; establishing, by the computer device, the initial flight path as the chosen flight path if the projected revised energy consumption is higher than the projected initial energy consumption; and sending, by the computer device, instructions to the first UAV to fly along the chosen flight path.

In another aspect of the invention, there is a computer program product including a computer readable storage medium having program instructions embodied therewith. The program instructions are executable by a computing device to cause the computing device to: retrieve an initial flight path for a first unmanned aerial vehicle (UAV), the initial flight path being from a geographical point A to a geographical point B; generate a projected initial energy consumption of the first UAV for completion of a flight along the initial flight path; retrieve a flight path of a second UAV; generate a projected revised energy consumption of the first UAV for completion of a flight along an altered flight path, the altered flight path being a flight path from point A to point B where the first UAV aerodynamically drafts the second UAV for at least a portion of the altered flight path; compare the projected revised energy consumption to the projected initial energy consumption to determine which of the projected revised energy consumption and the projected initial energy consumption is lower; establish the altered flight path as a chosen flight path if the projected revised energy consumption is lower than the projected initial energy consumption; establish the initial flight path as the chosen flight path if the projected revised energy consumption is higher than the projected initial energy consumption; and send instructions to the first UAV to fly along the chosen flight path.

In another aspect of the invention, there is system including a processor, a computer readable memory, and a computer readable storage medium. The system includes: program instructions to retrieve an initial flight path for a first unmanned aerial vehicle (UAV), the initial flight path being from a geographical point A to a geographical point B; program instructions to generate a projected initial energy consumption of the first UAV for completion of a flight along the initial flight path; program instructions to retrieve a flight path of a second UAV; program instructions to generate a projected revised energy consumption of the first UAV for completion of a flight along an altered flight path, the altered flight path being a flight path from point A to point B where the first UAV aerodynamically drafts the second UAV for at least a portion of the altered flight path; program instructions to compare the projected revised energy consumption to the projected initial energy consumption to determine which of the projected revised energy consumption and the projected initial energy consumption is lower; program instructions to establish the altered flight path as a chosen flight path if the projected revised energy consumption is lower than the projected initial energy consumption; program instructions to establish the initial flight path as the chosen flight path if the projected revised energy consumption is higher than the projected initial energy consumption; and program instructions to send instructions to the first UAV to fly along the chosen flight path. The program instructions are stored on the computer readable storage medium for execution by the processor via the computer readable memory.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION

Figure 1:
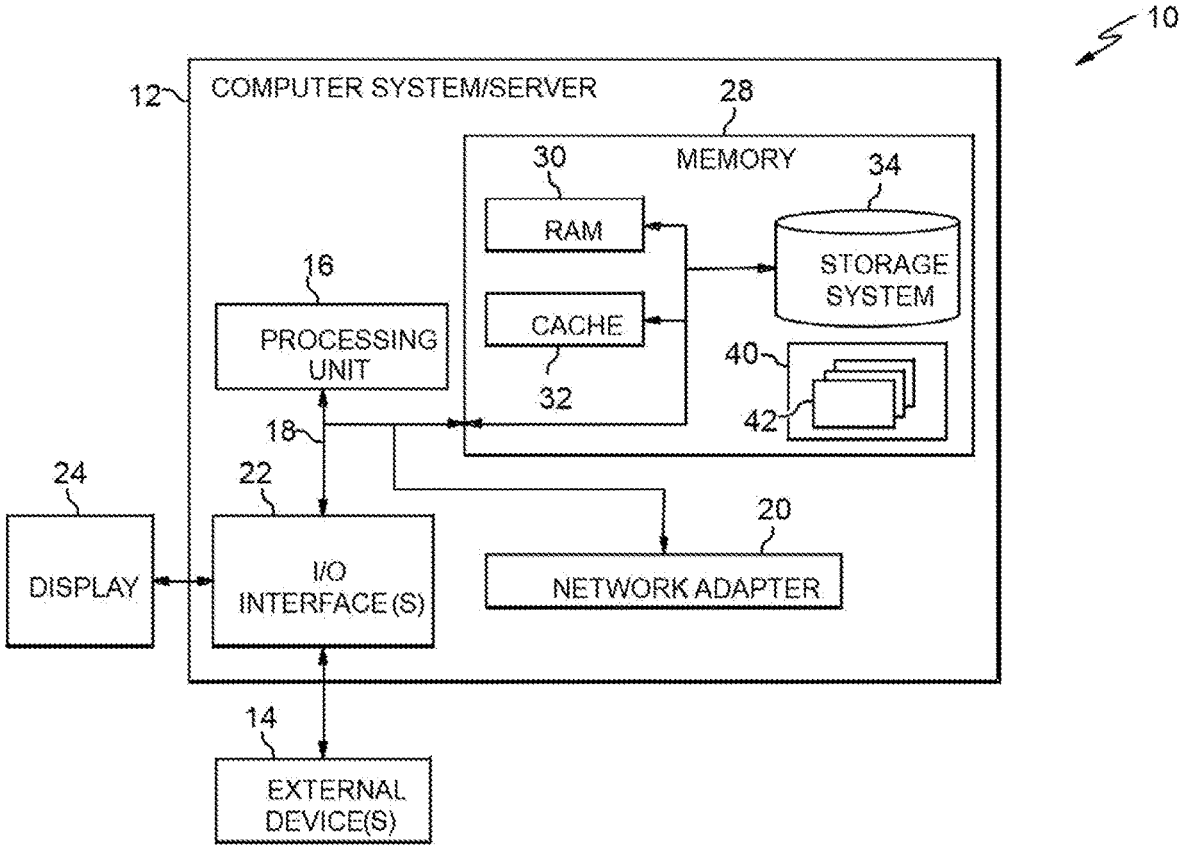
FIG. 1 depicts a cloud computing node according to an embodiment of the present invention.

With the rising popularity of UAVs for package delivery, and other uses, businesses and other entities are developing large fleets of UAVs. UAVs can extend an enormous amount of energy (battery or fuel) when flying, especially when flying into the wind. Maximizing flight range before requiring recharging/refueling can significantly increase the efficiency to a fleet of UAVs. Maximizing flight efficiency of a UAV in a single-UAV operation can be very beneficial because to allows longer flights and/or more flight to be conducted by the UAV before recharging/refueling is needed. As more shipments start to transition from land-based delivery methods to air-based methods, increasing UAV efficiency will become increasingly important.

The present invention relates generally to unmanned aerial vehicles and, more particularly, to improving the efficiency of unmanned aerial vehicles by altering flight paths to gain an aerodynamic advantage from drafting. According to aspects of the invention, a projected initial energy consumption of a first UAV is generated for completion of a flight along an initial flight path; a projected revised energy consumption of the first UAV is generated for completion of a flight along an altered flight path, the altered flight path being a flight path where the first UAV aerodynamically drafts the second UAV for at least a portion of the altered flight path; and a comparison of the projected revised energy consumption to the projected initial energy consumption is performed to determine which of the projected revised energy consumption and the projected initial energy consumption is lower. In embodiments, the flight path of the first UAV is changed to follow the second UAV for at least a portion of the entire flight in order to draft behind the second UAV. In this manner, implementations of the invention increase the efficiency of the first UAV (and, in some case, also the second UAV) by reducing the aerodynamic drag on one or both of the UAVs.

Advantageously, embodiments of the invention provide improvements to the technical field of unmanned aerial vehicle (UAV) flight optimization. By altering a flight path of a UAV to follow another UAV in order to take advantage of aerodynamic drafting, embodiments of the invention improve the efficiency and/or flight range of one or both of the UAVs. Embodiments of the invention also monitor the proximity of multiple UAVs (related and unrelated) during flight and generate energy consumption estimates for altered flight paths that include drafting behind one or more additional UAVs. The steps themselves are unconventional, and the combination of the steps is also unconventional. For example, the step of generating a projected revised energy consumption of the first UAV for completion of a flight along an altered flight path, the altered flight path being a flight path where the first UAV aerodynamically drafts the second UAV for at least a portion of the altered flight path creates new information that does not exist in the system (projected revised energy consumption data), and this new information is then used in subsequent steps in an unconventional manner.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 2:
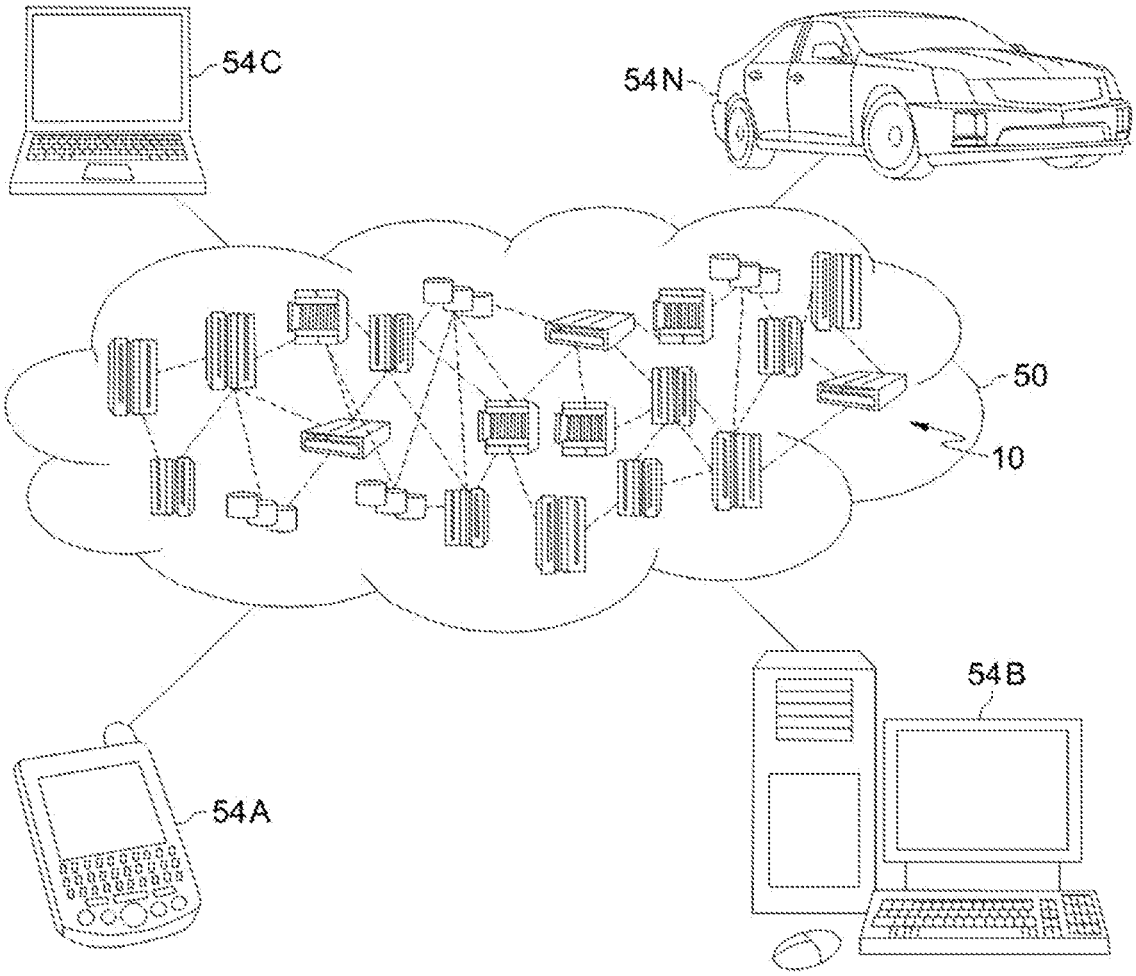
FIG. 2 depicts a cloud computing environment according to an embodiment of the present invention.

Referring now to FIG. 2, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 2 are intended to be illustrative only and that computing nodes 10 and cloud computing environment 50 can communicate with any type of computerized device over any type of network and/or network addressable connection (e.g., using a web browser).

Figure 3:
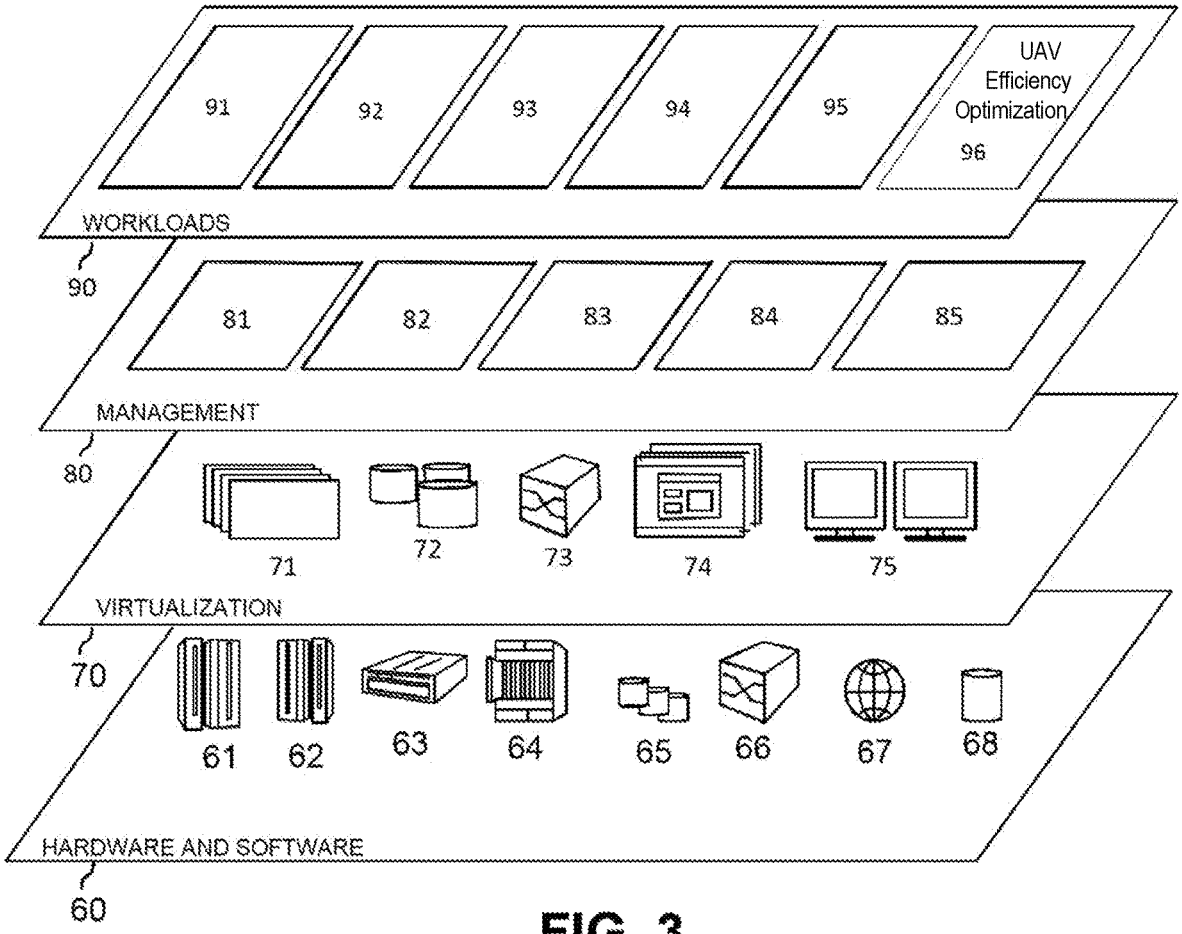
FIG. 3 depicts abstraction model layers according to an embodiment of the present invention.

Referring now to FIG. 3, a set of functional abstraction layers provided by cloud computing environment 50 (FIG. 2) is shown. It should be understood in advance that the components, layers, and functions shown in FIG. 3 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and UAV efficiency optimization 96.

Implementations of the invention may include a computer system/server 12 of FIG. 1 in which one or more of the program modules 42 are configured to perform (or cause the computer system/server 12 to perform) one of more functions of the UAV efficiency optimization 96 of FIG. 3. For example, the one or more of the program modules 42 may be configured to: retrieve an initial flight path for a first unmanned aerial vehicle (UAV), the initial flight path being from a geographical point A to a geographical point B; generate a projected initial energy consumption of the first UAV for completion of a flight along the initial flight path; retrieve a flight path of a second UAV; generate a projected revised energy consumption of the first UAV for completion of a flight along an altered flight path, the altered flight path being a flight path from point A to point B where the first UAV aerodynamically drafts the second UAV for at least a portion of the altered flight path; compare the projected revised energy consumption to the projected initial energy consumption to determine which of the projected revised energy consumption and the projected initial energy consumption is lower; establish the altered flight path as a chosen flight path if the projected revised energy consumption is lower than the projected initial energy consumption; establish the initial flight path as a chosen flight path if the projected revised energy consumption is higher than the projected initial energy consumption; and send instructions to the first UAV to fly along the chosen flight path.

It should be understood that, to the extent implementations of the invention collect, store, or employ personal information provided by, or obtained from, individuals (for example, computer device 300 obtaining flight paths of UAVs), such information shall be used in accordance with all applicable laws concerning protection of personal information. Additionally, the collection, storage, and use of such information may be subject to consent of the individual to such activity, for example, through "opt-in" or "opt-out" processes as may be appropriate for the situation and type of information. Storage and use of personal information may be in an appropriately secure manner reflective of the type of information, for example, through various encryption and anonymization techniques for particularly sensitive information.

Aerodynamic drafting, or just "drafting", is a technique used in sports and other activities in which wind resistance (the drag created by pushing gas molecules aside) has a negative impact on a body moving through the air. For example, cycling, motorsports, everyday driving, and even running, involve pushing a body through the air and, as a result, the requirement to overcome wind resistance. Cyclists often ride in a group and "draft" behind the lead rider, who divides the flow of air around himself/herself and the rest of the group. By following close behind the lead rider, the other riders gain the advantage of not having to divide the flow of air because the lead rider has already done so. As a result, the riders behind the lead rider expend less energy to maintain the same speed as the lead rider. Similarly, one or more racing cars will follow closely behind a lead car and gain the benefit of drafting. In some cases, the pack of multiple cars (the lead car and all the drafting cars) form a more aerodynamic unit that the lead car itself and, as a result, can reach a higher speed than the lead car can reach alone. Research has shown in that drafting reduces wind resistance by up to 27 percent and that a larger vehicle creates a low pressure are directly behind it.

Figure 4:
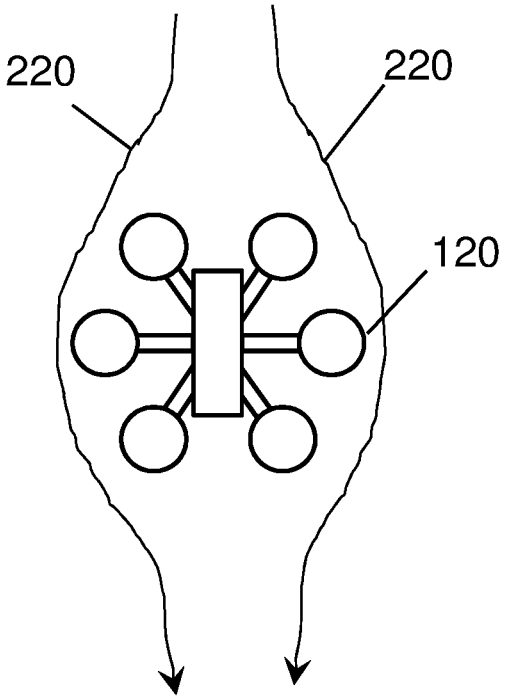
FIG. 4 shows a representation of air flowing around a UAV.
Figure 5:
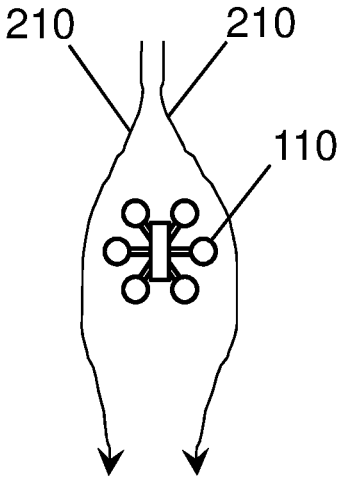
FIG. 5 shows a representation of air flowing around a UAV.
Figure 6:
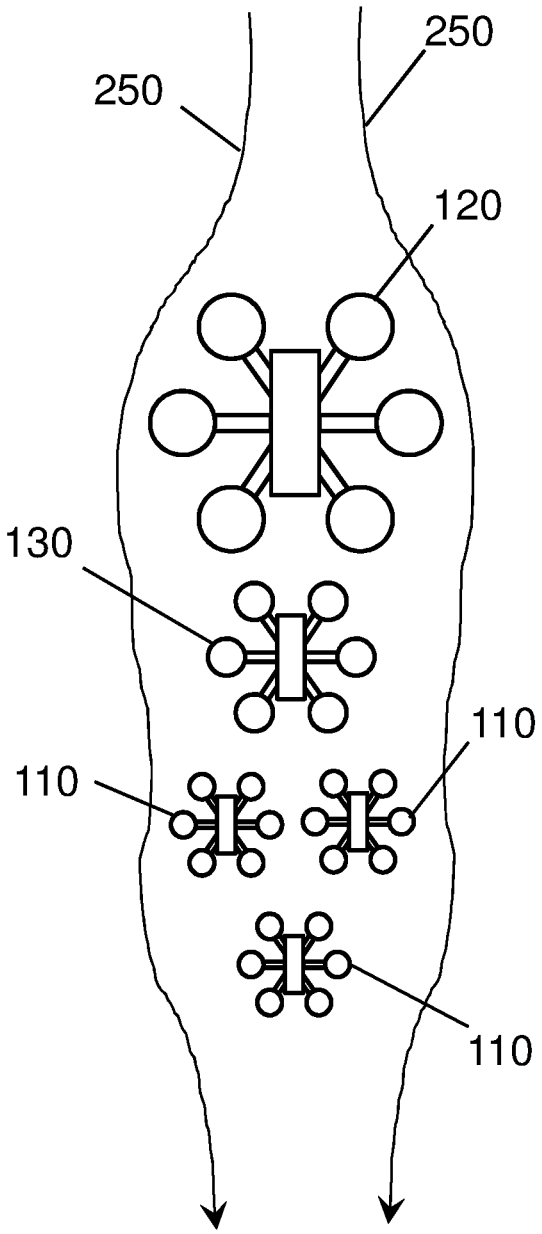
FIG. 6 shows a representation of air flowing around a group of UAVs.

In embodiments of the invention, aerodynamic drafting is taken advantage of by altering the flight path of a first UAV so that it follows and drafts a second UAV. FIG. 4 shows an example of a second UAV 120 and the air flow 220 separating and flowing around second UAV 120. FIG. 5 shows an example of a first UAV 110 and the air flow 210 separating and flowing around first UAV 110. If the first UAV is flying such that it is not near any other UAVs, then it will separate the air as shown in FIG. 5. A certain amount of energy in the form of, for example, fuel or battery power is required to push a given UAV through the air. FIG. 6 shows an example of the second UAV 120 acting as the lead UAV and separating the air into air flow 250. Also shown in FIG. 6 is a third UAV 130 and three of the first UAVs 110. In this example, the separation of the air flow into air flow 250 by the second UAV 120 reduces the wind resistance on the third UAV 130 and the first UAVs 110 because the third UAV 130 and the first UAVs 110 do not need to separate the air flow. It is noted that FIG. 6 is a schematic representation of the air flow around the UAVs and that there is still some wind resistance encountered by the third UAV 130 and the first UAVs 110.

As described above, UAVs following another UAV encounter a reduction in wind resistance and, therefore, a reduction in power consumption. In some cases, the lead UAV also experiences a reduction in drag because the group of UAVs, as a unit, form a more aerodynamic body than the lead UAV by itself. This can be particularly true if the group of UAVs form a shape, such as a teardrop, that produces less turbulence behind the shape.

Embodiments of the invention include systems and methods by which all relevant variables are considered as extractable features across multiple possible scenarios for the purpose of coordinating a variety of dynamic flight-path alterations to enable increased efficiency with respect to drafting, yet maintain both a safe and harmonic (well-coordinated) environment. Embodiments of the invention assemble and combine UAV flight paths and determine the most efficient path for a UAV (or multiple UAVs) considering the advantages of drafting.

In embodiments, a smaller UAV drafts behind (or in some other proximity to) a larger UAV. In embodiments, a path taken is longer than a direct path and more protracted in travel but has higher efficiency as the UAV uses less energy as a result of drafting. Embodiments produce the advantages of extended travel time, reduced wear, and reduced cost.

Embodiments of the invention determine the timing and direction of UAVs (for example, larger UAVs) in the vicinity of the projected flight path of the subject UAV and continuously update to determine the most efficient flight path. As this may increase the time to deliver a package, for example, embodiments include a policy setting for the user to override the more efficient route. In embodiments, a user can select to pay a surcharge or accept a "green discount" for more extended, but more efficient, routes. In embodiments, the data produced over time is stored to show trends in efficiencies of flights to prove historical baseline optimization levels resulting from drafting opportunities.

Figure 7:
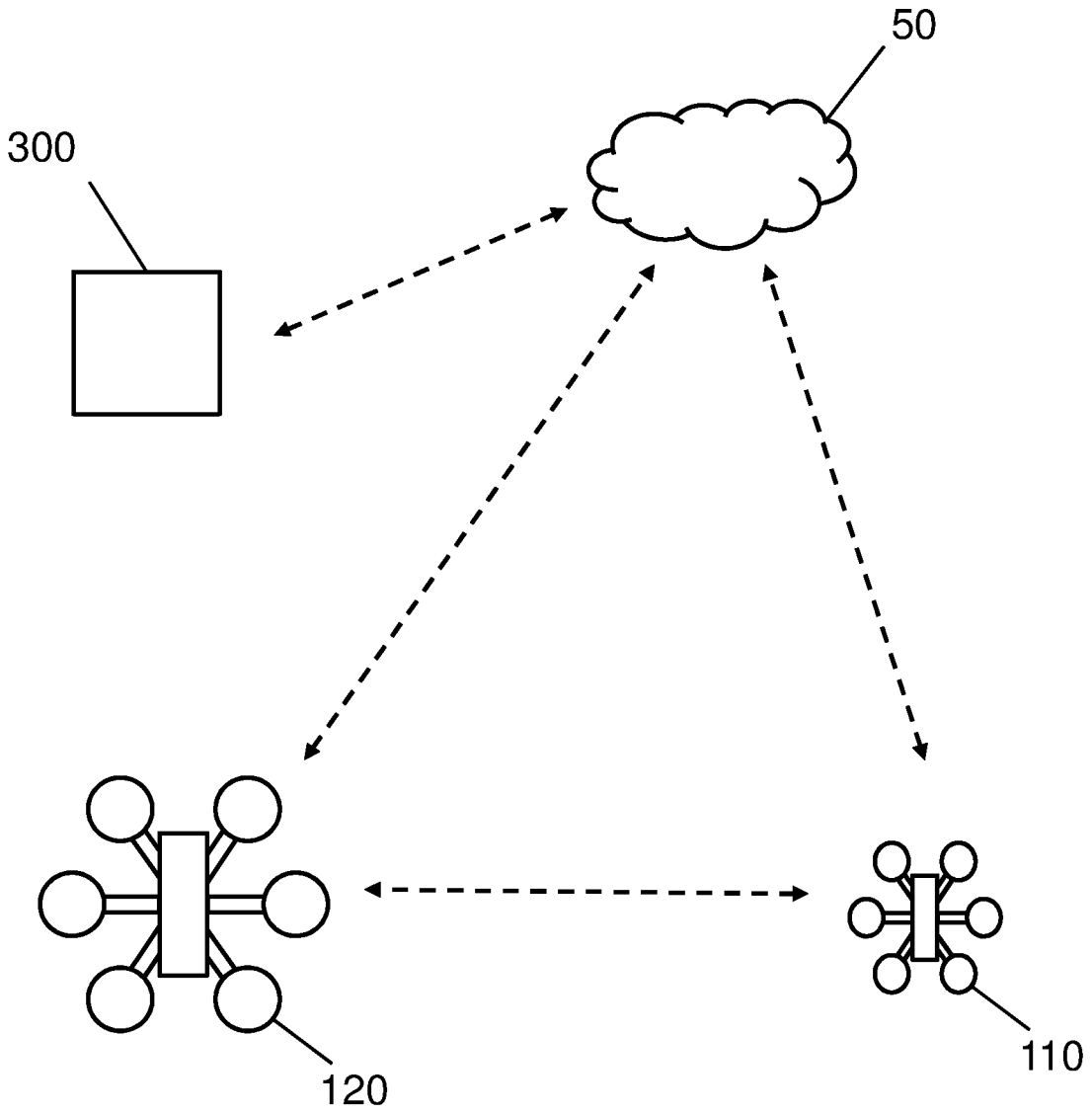
FIG. 7 shows a block diagram of an exemplary environment in accordance with aspects of the invention.

FIG. 7 shows a block diagram of an exemplary environment in accordance with aspects of the invention. In embodiments, the environment includes a computer device 300 that communicates with the first UAV 110 through a network of any type, such as, for example, the cloud computing environment 50. In embodiments, computer device 300 is computer system/server 12 that performs various functions related to the first UAV 110 (described in detail below). Also shown in FIG. 7 is the second UAV 120. The second UAV 120, in this example, communicates with the computer device 300 through the cloud computing environment 50. In the example shown in FIG. 7, the first UAV 110 and the second UAV 120 communicate both directly with each other, and through the cloud computing environment 50 without going through the computer device 300.

Figure 8:
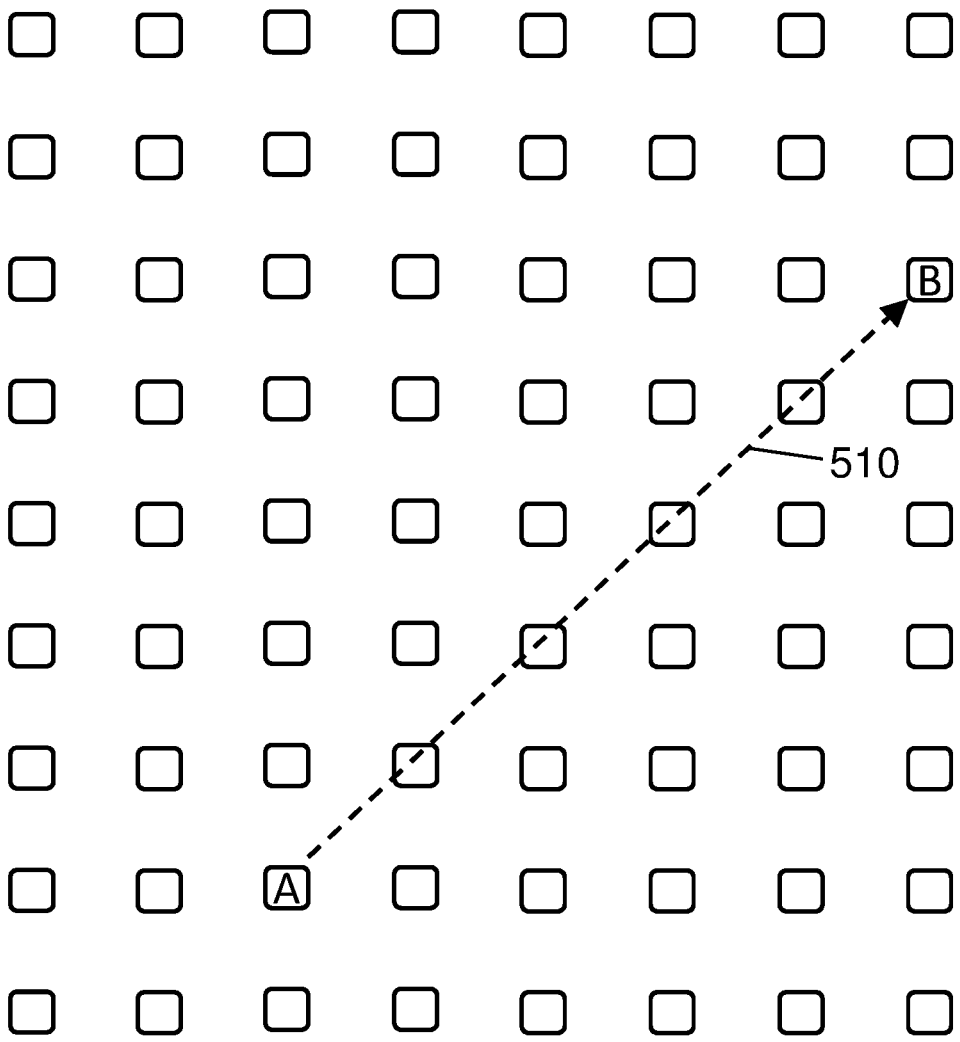
FIG. 8 shows a flight path of a UAV.
Figure 9:
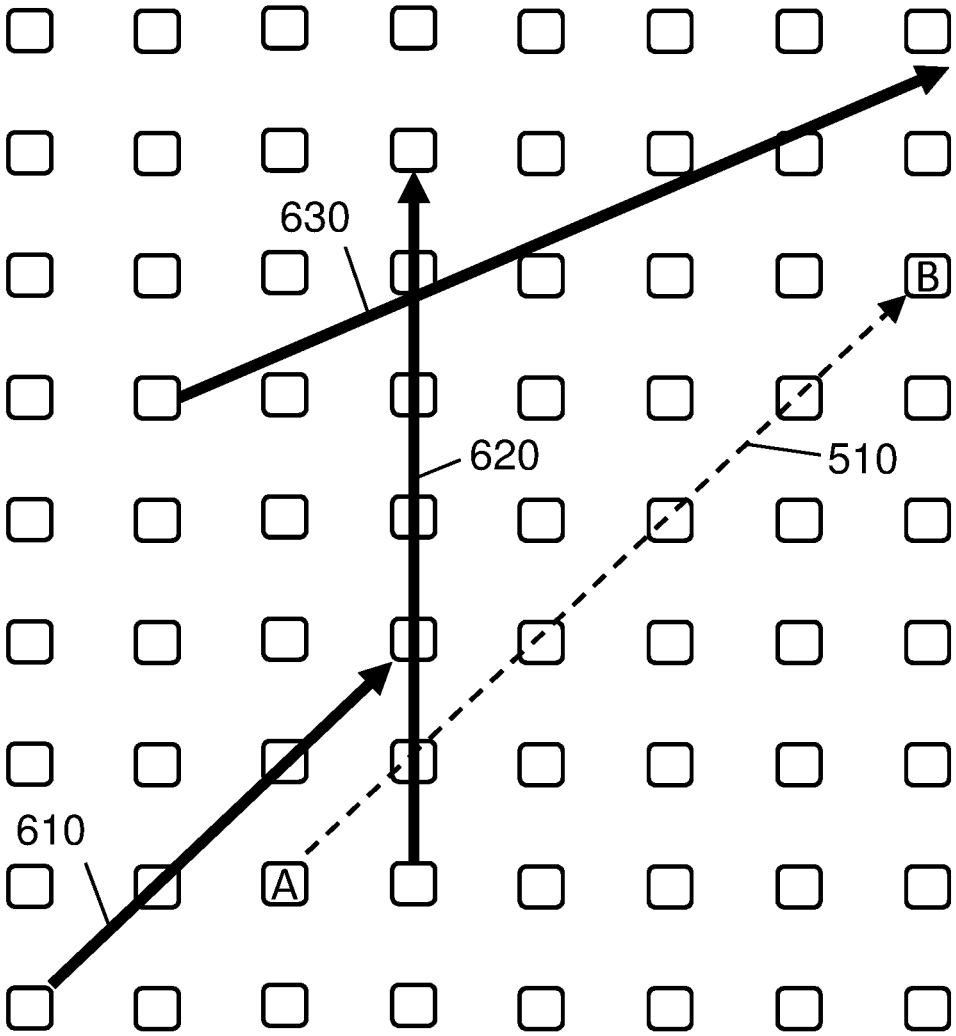
FIG. 9 shows flight paths of multiple UAVs.
Figure 10:
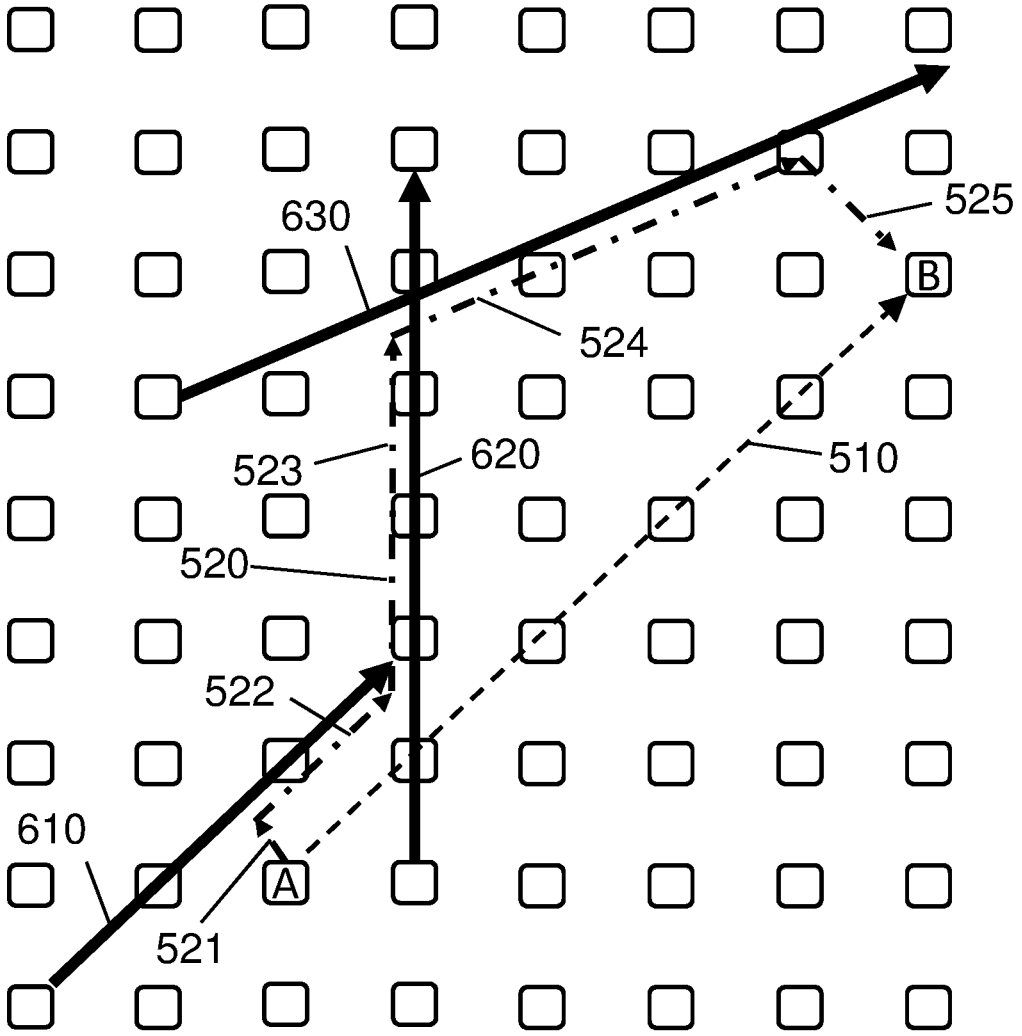
FIG. 10 shows a revised flight path according to an embodiment of the present invention.
Figure 11:
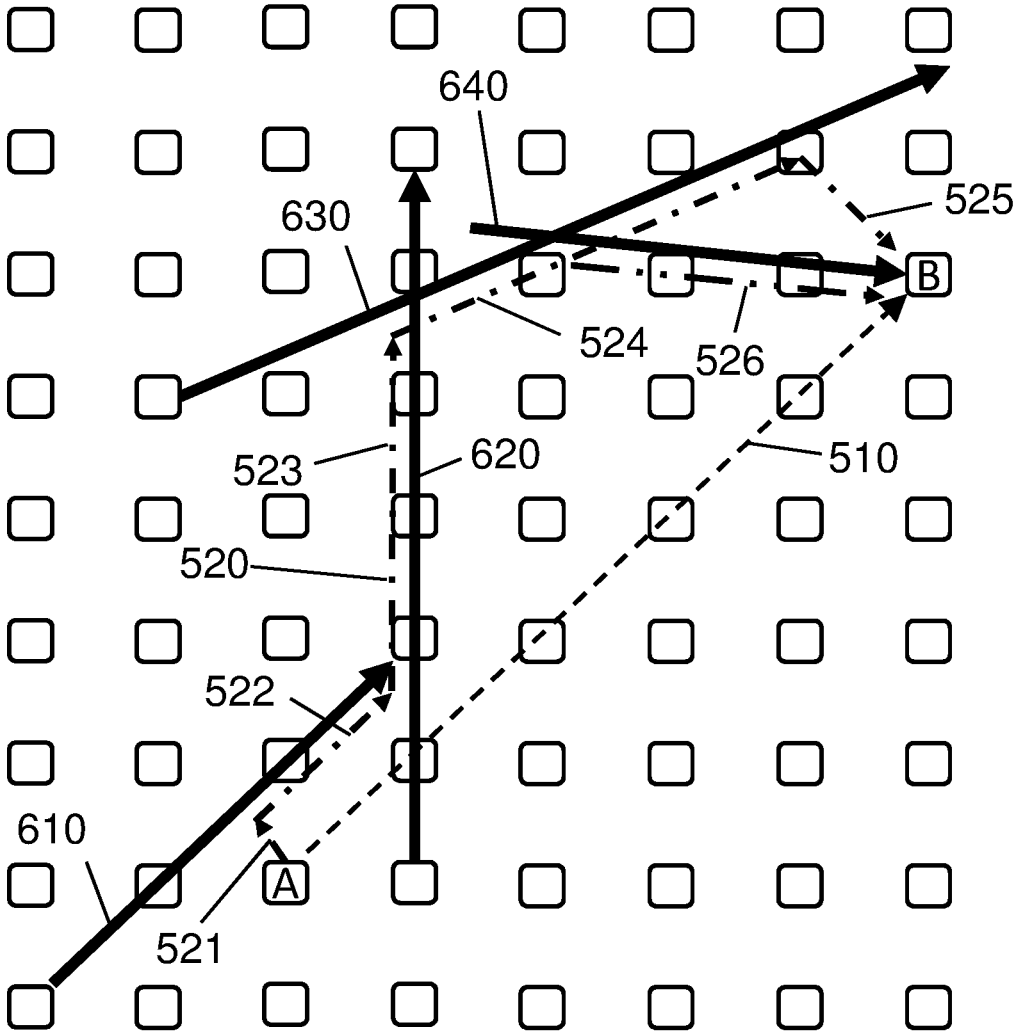
FIG. 11 shows a second revised flight path according to an embodiment of the present invention.

FIGS. 8-10 show an example of embodiments of the invention that generate an altered flight path for the first UAV 110 that takes advantage of the benefits of drafting. FIG. 11 shows an example of a second altered flight path of the first UAV 110.

FIG. 8 shows an initial flight path 510 of the first UAV 110 from point A to point B on a map. Initial flight path 510 is a straight line between points A and B and is the most efficient flight path without considering the benefits of embodiments of the invention.

FIG. 9 shows three additional the flight paths, each of which is a flight path of a UAV other than the first UAV 110. In examples, each of the three flight paths are of a different UAV, all three are of the same UAV, or some other combination. In the example shown in FIG. 9, the second UAV 120 flies along a flight path 610, another UAV flies along a flight path 620, and still another UAV flies along a flight path 630 during the flight of the first UAV 110 from point A to point B.

FIG. 10 shows an altered flight path 520 that includes segments 521, 522, 523, 524, 525 that lead from point A to point B. Each of the segments 522, 523, 524 follow one of the flight paths 610, 620, 630 of the other UAVs in order for the first UAV 110 to draft one of the other UAVs. While the segments 522, 523, 524 are shown to the side of the flight paths 610, 620, 630 for clarity, it is noted that the first UAV 110 will follow behind, or in some other proximity to, the other UAVs in order to draft the other UAVs. In the example shown in FIG. 10, the first UAV 110 has the initial flight path 510.

FIG. 11 shows an example of the chosen flight path (520 from FIG. 10) being altered during flight of the first UAV 110. In embodiments, this situation occurs when a previously unaccounted for UAV comes in proximity to the flight path of the first UAV 110 and the computer device 300 determines that the first UAV would benefit from drafting the previously unaccounted for UAV. For example, flight path 640 of the third UAV 130 shown in FIG. 11 now presents a shorter and more efficient route to point B than the chosen flight path 520. As a result, a second altered flight path 526 is chosen for the reminder of the flight of the first UAV 110.

Figure 12:
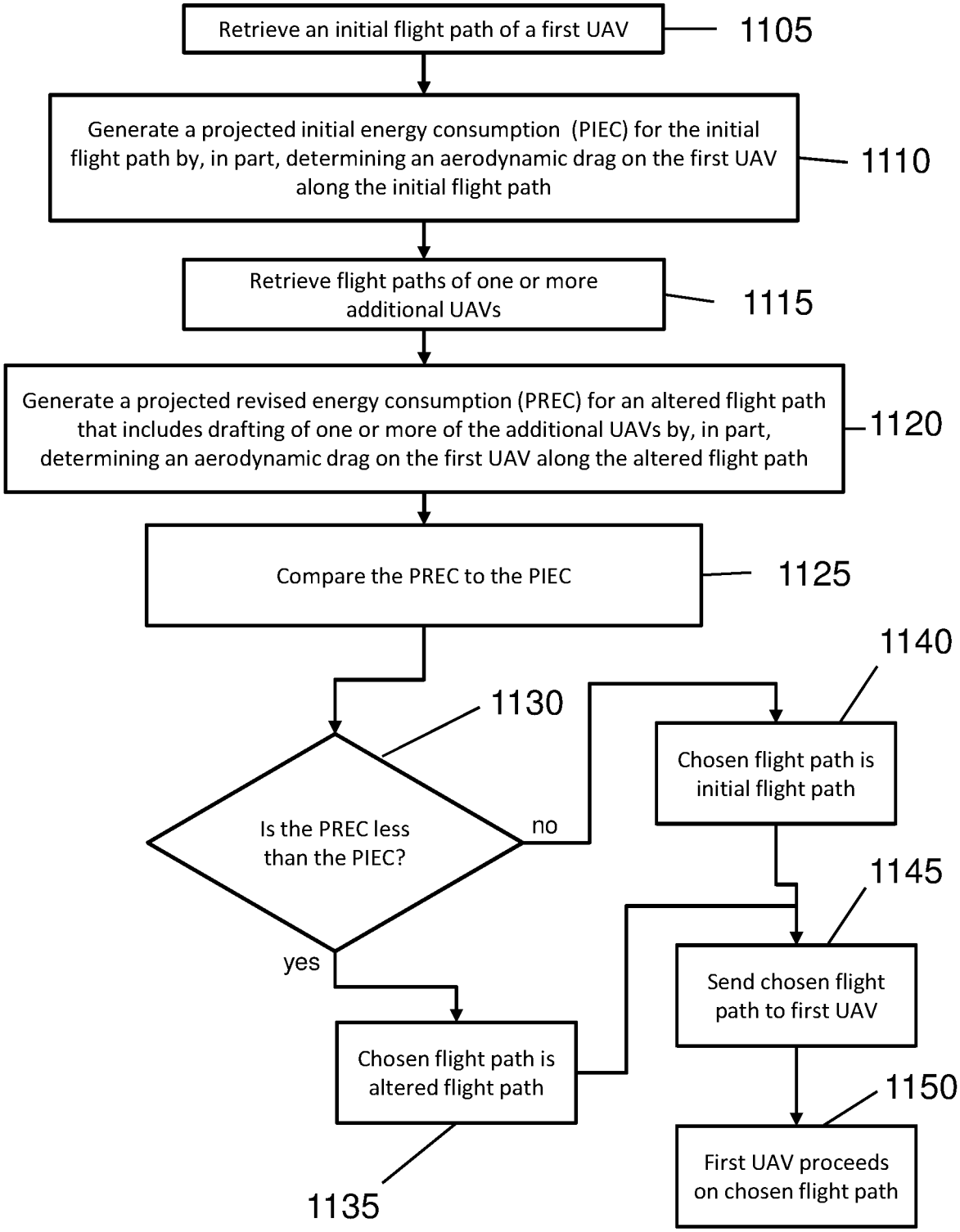
FIG. 12 shows a flowchart of an exemplary method in accordance with aspects of the invention.
Figure 13:
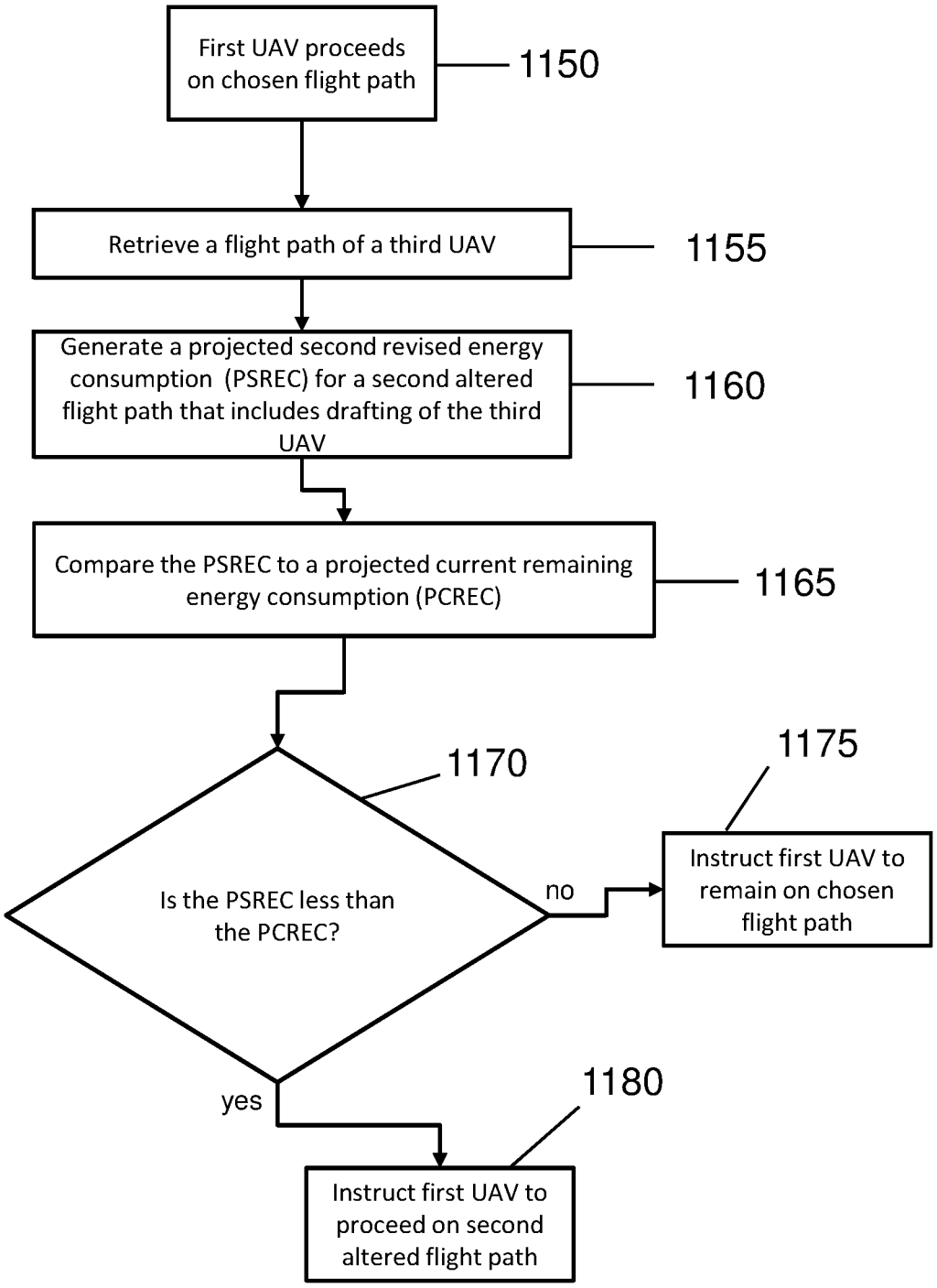
FIG. 13 shows a flowchart of an exemplary method in accordance with aspects of the invention.

FIGS. 12 and 13 show a flowchart of an exemplary method in accordance with aspects of the present invention. Steps of the method may be carried out in the environment of FIG. 7 and are described with reference to elements depicted in FIG. 7 and the flight paths shown in FIGS. 10 and 11.

At step 1105, the computer device 300 retrieves the initial flight path 510 of the first UAV 110 from, for example, the first UAV 110. In other embodiments, the computer device 300 retrieves the initial flight path 510 from a UAV control center or develops the initial flight path 510 itself if, for example, it controls the first UAV 110. At step 1110, the computer device 300 generates a projected initial energy consumption for the initial flight path 510 by, in part, determining an aerodynamic drag on the first UAV 110 along the initial flight path 510.

At step 1115, the computer device 300 retrieves one or more flight path 610, 620, 630 of the second UAV 120 (and other UAVs) from, for example, the second UAV 120 and the other UAVs. In other embodiments, the computer device 300 retrieves the flight paths 610, 620, 630 from a UAV control center, or develops the flight paths 610, 620, 630 itself if, for example, it controls the other UAVs. At step 1120, the computer device 300 generate a projected revised energy consumption for an altered flight path (such as altered flight path 520) that includes drafting of one or more of the additional UAVs by, in part, determining an aerodynamic drag on the first UAV 110 along the altered flight path 520.

In this example, the altered flight path 520 includes a first segment 521 in which the first UAV flies from point A to the flight path 610 of the second UAV 120 to meet the second UAV 120 and begin following (along segment 522) the second UAV 120 along the flight path 610 until it reaches the flight path 620 of another UAV. When the first UAV 110 meets the flight path 620, it turns and follows (along segment 523) the UAV traveling along the flight path 620. When the first UAV 110 meets the flight path 630, it turns and follows (along segment 524) the UAV traveling along the flight path 630. At a point calculated by the computer device 300 to be the most efficient point, the first UAV turns off of flight path 630 and travels (along segment 525) to point B. In each of the segments 522, 523, 524 where the first UAV 110 follows another UAV, the first UAV 110 gains the benefits of drafting another UAV and therefore reduces energy consumption.

At step 1125, the computer device 300 compares the projected revised energy consumption to the projected initial energy consumption. At step 1130, if the projected revised energy consumption is less than the projected initial energy consumption, then processing continues to step 1135 and the altered flight path 520 is chosen as the flight path of the first UAV 110. At step 1130, if the projected revised energy consumption is not less than the projected initial energy consumption, then processing continues to step 1140 and the initial flight path 510 is chosen as the flight path of the first UAV 110. In the example shown in FIG. 10, the computer device 300 establishes that the altered flight path 520 has a lower energy consumption than the initial flight path 510, so the computer device sends, at step 1145, the altered flight path 520 to the first UAV 110 as the chosen flight path for the first UAV 110 to follow from point A to point B. At step 1150, the first UAV 110 proceeds on the chosen flight path (in this example, the altered flight path 520).

Whereas the flow chart in FIG. 12 shows an example of the chosen flight path being established prior to the first UAV 110 beginning its flight from point A to point B, the flow chart in FIG. 13 shows an example of the chosen flight path being altered during flight of the first UAV 110. In embodiments, this situation occurs when a previously unaccounted for UAV comes in proximity to the flight path of the first UAV 110. At step 1150 of FIG. 13, the first UAV 110 proceeds on the chosen flight path as established, for example, in FIG. 12. At step 1155, the computer device 300 retrieves a flight path of another UAV, for example flight path 640 of the third UAV 130 shown in FIG. 11. At step 1160, the computer device 300 generate a projected second revised energy consumption for the second altered flight path 526 that includes drafting of the third UAV 130 by, in part, determining an aerodynamic drag on the first UAV 110 along the second altered flight path 526.

At step 1165, the computer device 300 compares the projected second revised energy consumption to a projected current remaining energy consumption. At step 1170, if the revised second energy consumption is less than the projected current remaining energy consumption, then processing continues to step 1180 and the computer device 300 instructs the first UAV 110 to proceed to the second altered flight path 526. At step 1170, if the projected second revised energy consumption is not less than the projected current remaining energy consumption, then processing continues to step 1175 and the computer device 300 instructs the first UAV 110 to remain on the chosen flight path, in this example altered flight path 520.

The above exemplary embodiments are described in reference to the first UAV 110. It is noted that in embodiments, the flight paths of the second UAV 120, the third UAV 130, and/or other UAVs are analyzed by the computer device 300 in the same or similar manner as described above with regard to the flight path of the first UAV 110. In embodiments, the computer device 300 would consider drafting in the flight paths of only those UAVs that are larger than the first UAV 110 when generating energy consumption for comparison purposes. In embodiments, the computer device 300 would consider drafting in the flight paths of all other UAVs when generating energy consumption for comparison purposes.

In embodiments of the invention, UAVs are able to communicate with one another for possible interactions are defined. The computer device 300, for example, determines which UAVs meet prerequisites for drafting (for example, UAVs that are flying from the same origin to the same destination and share the same takeoff time). The UAVs launch and then synchronize in the air. In embodiments, the synchronization includes: one UAV being specified as the lead UAV; and one or more UAVs being specified as a follower UAV (the leader to follower ratio equals a one to many type of relationship, and the lead drone can change while in flight). In embodiments, sensors such as flight path sensors and drafting sensors are checked to determine the efficiency of the location of each UAV within the group. In embodiments, the computer device 300 performs an iterative process to refine the position of each UAV in the group to optimize the energy efficiency of the UAV and/or the efficiency of the group as a whole. After landing, the UAVs download flight information (including drafting information) to, for example, the computer device 300 to develop and refine a database of drafting data.

In embodiments, a particular UAV has the option of opting-in to a group of UAVs. In embodiments, some or all of the processing described in this disclosure takes place on the computer device 300. In embodiments, some or all of the processing described in this disclosure takes place on the UAV.

In embodiments, one or more smaller UAVs make a physical attachment to a more massive UAV for part of the distance to further reduce energy consumption of the smaller UAVs. In embodiments, multiple UAVs (for example empty UAVs that have completed deliveries) attach to each other to form, in effect, a larger UAV that flies as the lead UAV to create drafting for other UAVs. In embodiments, the computer device 300 analyzes a group of UAVs that are in a predetermined proximity to each other to determine the most efficient formation for drafting. For example, the group of UAVs can be rearranged so that the largest UAV (for example, the UAV with the largest frontal area) is in the front of the group, the smallest UAV is in the back of the group, and intermediate size UAVs are positioned between the largest UAV and the smallest UAV. FIG. 6 shows an example of such a formation. In embodiments, the computer device 300 arranges the UAVs that are in proximity to each other in a formation that is V shaped, staggered by elevation, vertically stacked, or any other formation that provides the befits of drafting.

In embodiments, a UAV operator that delivers packages intentionally creates a large package to be carried by a large UAV in order to provide drafting for smaller UAVs. Conversely, in embodiments, the UAV operator that delivers packages intentionally splits up a delivery to one customer into a plurality of small packages so that those UAVs gain the benefit of drafting behind a large UAV that is traveling on the same, or a similar, route.

Embodiments include receiving flight plans of a first UAV in flight and predicted flight pattern of a second UAV; and modifying flight plans of the first UAV and the second UAV in a coordinated manner such that the flight plans of both the first UAV and the second UAV are energy efficient. Embodiments include modifying flight plans of the first UAV and the second UAV in a coordinated manner such that the flight plans of both the first UAV and the second UAV are energy efficient comprises; creating a new flight plan for the first UAV and the second UAV such that the first UAV and the second UAV work in concert, wherein the new flight plan is based, at least in part, on current and predicted headwind, speed, altitude, and distance traveled by each respective UAV; and calculating an optimal drafting position for either the first UAV or the second UAV based on speed, proximity to another UAV, destination, and altitude.

Embodiments include establishing the first UAV as a lead UAV and the second UAV as a drafting UAV. Embodiments include establishing the second UAV as the lead UAV and the first UAV as the drafting UAV at specified portions of the new flight plan based on current and predicted headwind, speed, altitude, and distance traveled by each respective UAV. Embodiments include receiving a flight plan of a third UAV in flight; and modifying the flight plan of the third UAV in flight in a coordinated manner to maximize efficiency between the first UAV, the second UAV, and the third UAV based, at least in part on current and predicted headwind, speed, altitude, and distance traveled by each respective UAV.

In embodiments, the computer device 300 retrieves the flight paths of multiple UAVs from a cooperative association through which the owners and/or operators of UAVs share flight path information and other UAV information. A purpose of such a cooperative association is to improve the efficiency of many UAVs through the methods described in this disclosure.

In embodiments, a service provider could offer to perform the processes described herein. In this case, the service provider can create, maintain, deploy, support, etc., the computer infrastructure that performs the process steps of the invention for one or more customers. These customers may be, for example, any business that uses technology. In return, the service provider can receive payment from the customer(s) under a subscription and/or fee agreement and/or the service provider can receive payment from the sale of advertising content to one or more third parties.

In still additional embodiments, the invention provides a computer-implemented method, via a network. In this case, a computer infrastructure, such as computer system/server 12 (FIG. 1), can be provided and one or more systems for performing the processes of the invention can be obtained (e.g., created, purchased, used, modified, etc.) and deployed to the computer infrastructure. To this extent, the deployment of a system can comprise one or more of: (1) installing program code on a computing device, such as computer system/server 12 (as shown in FIG. 1), from a computer-readable medium; (2) adding one or more computing devices to the computer infrastructure; and (3) incorporating and/or modifying one or more existing systems of the computer infrastructure to enable the computer infrastructure to perform the processes of the invention.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer-implemented method comprising:

retrieving, by a computer device, an initial flight path for a first unmanned aerial vehicle (UAV), the initial flight path being from a geographical point A to a geographical point B;

generating, by the computer device, a projected initial energy consumption of the first UAV for completion of a flight along the initial flight path;

retrieving, by the computer device, a flight path of a second UAV;

generating, by the computer device, a projected revised energy consumption of the first UAV for completion of a flight along an altered flight path, the altered flight path being a flight path from the geographical point A to the geographical point B where the first UAV aerodynamically drafts behind the second UAV for at least a portion of the altered flight path;

comparing, by the computer device, the projected revised energy consumption to the projected initial energy consumption to determine which of the projected revised energy consumption and the projected initial energy consumption is lower;

establishing, by the computer device, the altered flight path as a chosen flight path if the projected revised energy consumption is lower than the projected initial energy consumption; and changing, by the computer device, the initial flight path for the first UAV to follow the second UAV for the at least a portion of the altered flight path in order to draft behind the second UAV.

2. The computer-implemented method of claim 1, wherein the computer device is a part of the first UAV.

3. The computer-implemented method of claim 1, wherein the computer device retrieves the flight path of the second UAV over a telecommunications network.

4. The computer-implemented method of claim 1, wherein the computer device retrieves the flight path of the second UAV from a cooperative association through which UAVs share UAV flight path information.

5. The computer-implemented method of claim 1, wherein the computer device retrieves the flight path of the second UAV from the second UAV.

6. The computer-implemented method of claim 1, wherein a frontal area of the second UAV is larger than a frontal area of the first UAV.

7. The computer-implemented method of claim 1, further comprising:

retrieving, by the computer device, a flight path of a third UAV, wherein the generating, by the computer device, of the projected revised energy consumption includes the first UAV aerodynamically drafting behind the third UAV for at least a second portion of the altered flight path.

8. The computer-implemented method of claim 1, further comprising:

retrieving, by the computer device, a flight path of a third UAV while the first UAV is in flight;

generating, by the computer device, a projected second revised energy consumption of the first UAV for completion of a flight along a second altered flight path, the second altered flight path being a flight path from a current position of the first UAV to the geographical point B, where the first UAV aerodynamically drafts behind the third UAV for at least a portion of the second altered flight path;

comparing, by the computer device, the projected second revised energy consumption to a projected current remaining energy consumption to determine which of the projected second revised energy consumption and the projected current remaining energy consumption is lower;

establishing, by the computer device, the second altered flight path as a new flight path if the projected second revised energy consumption is lower than the projected current remaining energy consumption; and sending, by the computer device, instructions to the first UAV to fly along the new flight path if the new flight path is established.

9. The computer-implemented method of claim 1, further comprising:

determining, by the computer device, an initial aerodynamic drag on the first UAV associated with the first UAV traveling from the geographical point A to the geographical point B along the initial flight path; and determining, by the computer device, a revised aerodynamic drag on the first UAV associated with the first UAV traveling from the geographical point A to the geographical point B along the altered flight path, wherein the generating of the projected initial energy consumption is based on the initial aerodynamic drag, and the generating of the projected revised energy consumption is based on the revised aerodynamic drag.

10. The computer-implemented method of claim 1, wherein the computer device includes software provided as a service in a cloud environment.

11. A computer program product, the computer program product comprising a computer readable storage medium having program instructions embodied therewith, the program instructions executable by a computing device to cause the computing device to:

retrieve an initial flight path for a first unmanned aerial vehicle (UAV), the initial flight path being from a geographical point A to a geographical point B;

generate a projected initial energy consumption of the first UAV for completion of a flight along the initial flight path;

retrieve a flight path of a second UAV;

generate a projected revised energy consumption of the first UAV for completion of a flight along an altered flight path, the altered flight path being a flight path from the geographical point A to the geographical point B where the first UAV aerodynamically drafts behind the second UAV for at least a portion of the altered flight path;

compare the projected revised energy consumption to the projected initial energy consumption to determine which of the projected revised energy consumption and the projected initial energy consumption is lower;

establish the altered flight path as a chosen flight path if the projected revised energy consumption is lower than the projected initial energy consumption; and change the initial flight path for the first UAV to follow the second UAV for the at least a portion of the altered flight path in order to draft behind the second UAV.

12. The computer program product of claim 11, further comprising program instructions executable by the computing device to cause the computing device to retrieve a flight path of a third UAV, wherein the generation of the projected revised energy consumption includes the first UAV aerodynamically drafting behind the third UAV for at least a second portion of the altered flight path.

13. The computer program product of claim 11, further comprising program instructions executable by the computing device to cause the computing device to:

retrieve a flight path of a third UAV while the first UAV is in flight;

generate a projected second revised energy consumption of the first UAV for completion of a flight along a second altered flight path, the second altered flight path being a flight path from a current position of the first UAV to the geographical point B, where the first UAV aerodynamically drafts behind the third UAV for at least a portion of the second altered flight path;

compare the projected second revised energy consumption to a projected current remaining energy consumption to determine which of the projected second revised energy consumption and the projected current remaining energy consumption is lower;

establish the second altered flight path as a new flight path if the projected second revised energy consumption is lower than the projected current remaining energy consumption; and send instructions to the first UAV to fly along the new flight path if the new flight path is established.

14. The computer program product of claim 11, the flight path of the second UAV is received from the second UAV.

15. The computer program product of claim 11, wherein a frontal area of the second UAV is larger than a frontal area of the first UAV.

16. A system comprising:

a processor, a computer readable memory, and a computer readable storage medium;

program instructions to retrieve an initial flight path for a first unmanned aerial vehicle (UAV), the initial flight path being from a geographical point A to a geographical point B;

program instructions to generate a projected initial energy consumption of the first UAV for completion of a flight along the initial flight path;

program instructions to retrieve a flight path of a second UAV;

program instructions to generate a projected revised energy consumption of the first UAV for completion of a flight along an altered flight path, the altered flight path being a flight path from the geographical point A to the geographical point B where the first UAV aerodynamically drafts behind the second UAV for at least a portion of the altered flight path;

program instructions to compare the projected revised energy consumption to the projected initial energy consumption to determine which of the projected revised energy consumption and the projected initial energy consumption is lower;

program instructions to establish the altered flight path as a chosen flight path if the projected revised energy consumption is lower than the projected initial energy consumption; and program instructions to change the initial flight path for the first UAV to follow the second UAV for the at least a portion of the altered flight path in order to draft behind the second UAV, wherein the program instructions are stored on the computer readable storage medium for execution by the processor via the computer readable memory.

17. The system of claim 16, wherein the processor is a part of the first UAV.

18. The system of claim 16, wherein the processor is located remotely from the first UAV.

19. The system of claim 18, wherein the processor is a cloud-based server.

20. The system of claim 16, further comprising:

program instructions to retrieve a flight path of a third UAV while the first UAV is in flight;

program instructions to generate a projected second revised energy consumption of the first UAV for completion of a flight along a second altered flight path, the second altered flight path being a flight path from a current position of the first UAV to the geographical point B, where the first UAV aerodynamically drafts behind the third UAV for at least a portion of the second altered flight path;

program instructions to compare the projected second revised energy consumption to a projected current remaining energy consumption to determine which of the projected second revised energy consumption and the projected current remaining energy consumption is lower;

program instructions to establish the second altered flight path as a new flight path if the projected second revised energy consumption is lower than the projected current remaining energy consumption; and program instructions to send instructions to the first UAV to fly along the new flight path if the new flight path is established.

* * * * *